United States Patent [19]

Weir

[11] 4,345,391

[45] Aug. 24, 1982

[54] LAUNDRY FEEDING MACHINE

[76] Inventor: Henry J. Weir, "Alta Vista" Knapton Rd., Dublin, Ireland

[21] Appl. No.: 167,213

[22] Filed: Jul. 9, 1980

[30] Foreign Application Priority Data

Jul. 9, 1979 [IE] Ireland ..... 486/79

[51] Int. Cl.[3] ..... D06F 67/04

[52] U.S. Cl. ..... 38/143

[58] Field of Search ..... 38/143

[56] References Cited

U.S. PATENT DOCUMENTS

| | | | |
|---|---|---|---|
| 3,376,036 | 4/1968 | Weir | 38/143 |
| 3,421,756 | 1/1969 | Weir | 38/143 |
| 3,431,665 | 3/1969 | Weir | 38/143 |
| 3,729,846 | 5/1973 | Weir | 38/143 |
| 3,736,678 | 6/1973 | Kamberg | 38/143 |
| 3,909,964 | 10/1975 | Wenck | 38/143 |
| 4,050,173 | 9/1977 | Olsen | 38/143 |
| 4,106,227 | 8/1978 | Allen et al. | 38/143 |

*Primary Examiner*—Louis Rimrodt

*Attorney, Agent, or Firm*—Wallenstein, Wagner, Hattis, Strampel & Aubel

[57] ABSTRACT

A laundry feeding machine, particularly suitable for feeding small-piece flat-work articles to an ironing machine. A pair of clamping devices is arranged to accept any part of the leading edge of an article. The devices are moved apart symmetrically with respect to a feeding line of the machine, and as they move, the leading edge of the article runs through them. Each clamping device has a sensor which detects the side edge of the article and on such detection the clamping device is locked on to the article to hold it firmly. When both devices are locked the article is released and thus fed on to a feeding conveyor.

15 Claims, 7 Drawing Figures

FIG. 4
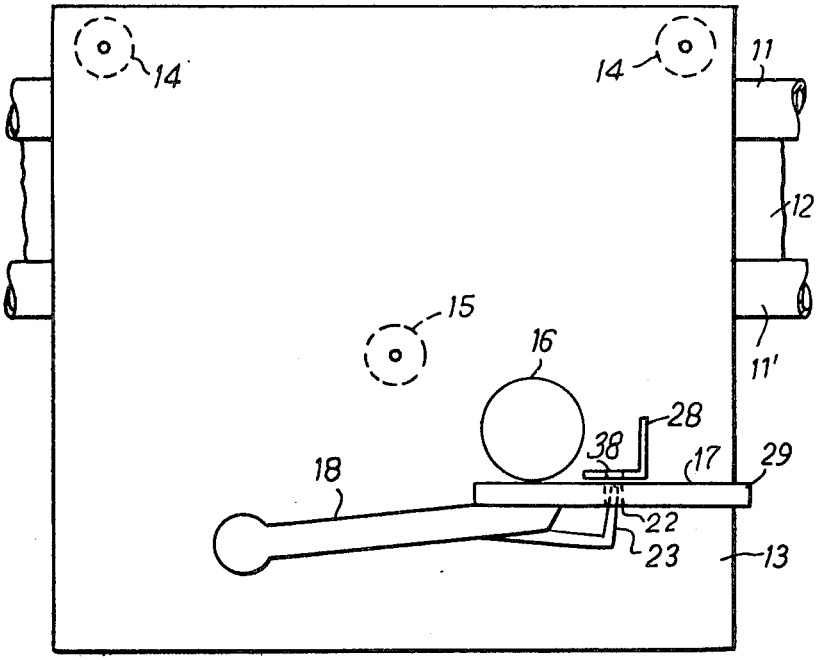
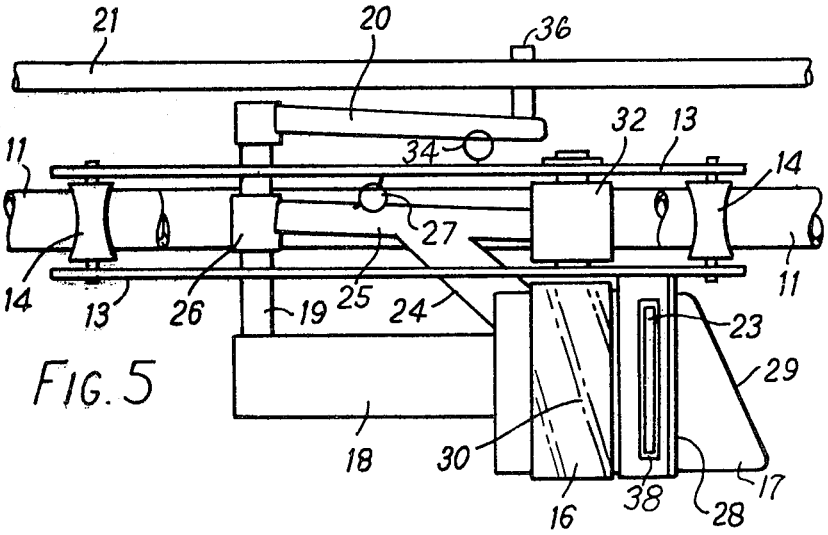
FIG. 5

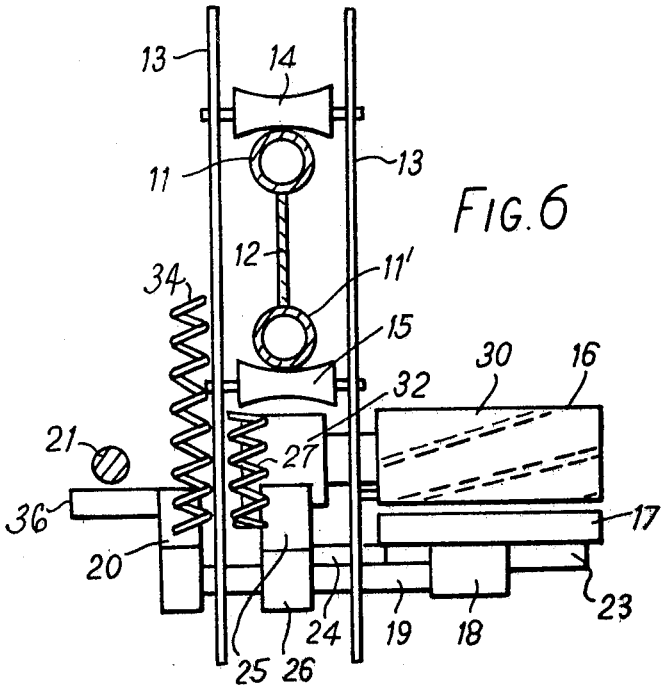
FIG. 6
FIG. 7
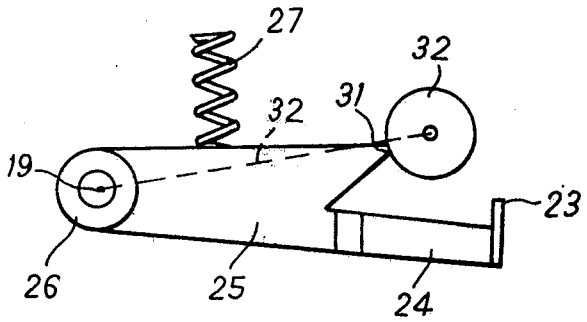

LAUNDRY FEEDING MACHINE

The invention relates to a laundry feeding machine for feeding laundry flat-work articles such as tablecloths, napkins, etc., to an ironing machine. Such feeding machines generally comprise a conveyor on which the articles are laid and machines are known in which the corners of the article to be fed are placed by hand in respective clamps which are then drawn apart to stretch the leading edge of the article. The clamps are subsequently released as the leading part of the article is laid on the conveyor, either by drawing the clamps forward over the conveyor or by means of an air blast which blows the article down and forwards on to the conveyor.

After ironing, the articles are fed to a folding machine which may make several folds, at least one of which is about a fold line extending down the length of the article. For such folding to be accurate it is necessary to feed the article to the folding machine with its centre line accurately aligned with a predetermined fold line of the machine. Since the articles are conveyed automatically from the feeder conveyor to the ironing machine and thence to the folding machine, folding accuracy depends upon the accuracy with which the articles are laid on the feeder conveyor.

The problem of folding accurately is particularly accute with small-piece flat-work articles such as napkins, tablecloths, etc,. If a corner-clamp arrangement of the kind described above is used, time is wasted in finding the corners and inserting them in turn into the clamps. Also, if this is done hurriedly, margins of the article of indeterminate width may be left to overhang the clamps at the sides, so that even through the clamps may be positioned accurately, the article is misaligned with respect to the required feed line. Thus, it is common practice to lay small piece articles directly on to the conveyor and this often results in poor folding because of misalignment.

The present invention seeks to provide an arrangement which will overcome these disadvantages.

According to the invention there is provided a laundry feeding machine having a pair of clamp devices movable towards and away from each other symmetrically with respect to a predetermined feeding line of the machine, it being possible to insert any part of the leading edge of a laundry article into the two clamp devices when they are together; means for retaining the leading edge of the article in the clamp devices while allowing the leading edge to run through the clamp devices as they are drawn apart; sensor means associated with each clamp device for detecting the respective side edge of the article as it is about to run through the clamp device; and means responsive to the sensor means to lock the respective clamp device on to the article, whereby the first side edge detected at a clamp device causes the clamp device to lock and the article is pulled through the other clamp device until the second side edge is detected whereupon that clamp device is locked also, and the article is aligned with the feeding line. For large articles the feeding line may be the centre line of the machine. For small articles there may be two or more parallel lines, each with respective pairs of clamp devices.

In a preferred embodiment of the invention in each clamp device there is an upper jaw which is a roller; a lower jaw which is a plate resiliently urged towards the roller, and the article, in being drawn across the device, slides on the plate and rotates the roller; the locking means comprises a brake arrangement having a jamming member pivoted about an axis parallel with the roller axis, and the sensor means comprises a tongue which is urged by a spring to project upwardly through an aperture in the lower jaw plate, the tongue being mechanically linked to the jamming member, the arrangement being such that as the tongue is allowed to move upwardly on passage of the corner of the article, corresponding movement of the jamming member moves the jamming member into contact with the surface of the rotating roller thereby jams and locks the roller.

In other embodiments of the invention both jaws may be smooth plates of metal or plastics material urged together by springs or pneumatic action with such a pressure as to allow the laundry article to slide through the plates. The locking means may be a device for applying considerably more pressure to the plates to stop the article sliding, or it may comprise a second set of jaws with gripping surfaces which clamp the article, or it may comprise a set of fine needles which penetrate the article and thereby grip it.

The side edge sensor need not be a mechanical feeler. Instead it may comprise a photo-electric detector arrangement having a light source and a photo-detector between which passes the article. When the corner of the article clears the photo-detector, a response is obtained to actuate the locking means, which may be electromechanical. In an alternative embodiment, the edge detector is pneumatic, the laundry article being effective to obstruct a flow of air from a jet arranged next to the jaws. When the side edge of the article clears the jet, the pressure change is used to actuate the locking means, which in this case is conveniently pneumatic.

The invention will further be described with reference to the accompanying drawings, in which:

FIG. 4 is a front elevation of one of the jaw mechanisms of the machine of FIGS. 1 to 3;

FIG. 5 is a plan view of the mechanism of FIG. 4;

FIG. 6 is an end elevation of the mechanism of FIGS. 4 and 5, and

FIG. 7 is a front elevation illustrating the brake arrangement of the mechanism of FIGS. 4 to 6.

Figure 1:
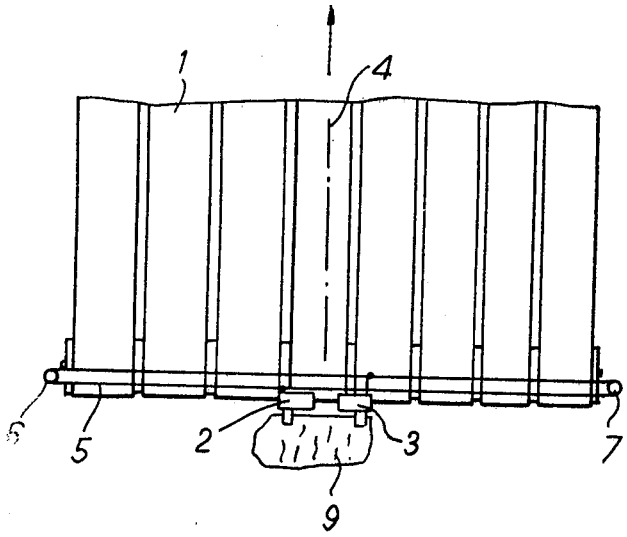
FIG. 1 is a schematic illustration in plan view of part of a laundry machine in accordance with the invention.

Referring to FIG. 1 the feeding machine comprises a conveyor 1 which is driven forwards in the direction indicated by the arrow to feed laundry articles through an ironing machine (not shown). At the feeding edge of the conveyor is a pair of clamping and guide means in the form of left and right jaw mechanisms 2 and 3 which are movable together and apart symmetrically relative to the centre line 4 of the machine. The means for moving the clamp is shown as an endless drive belt 5 which passes over pulleys 6 and 7. Mechanism 2 is fixed to one run of the belt 5 and mechanism 3 is fixed to the other run. It will be seen that when the belt is driven, as by a rotary drive applied to one of the pulleys 6, 7 the mechanism will be moved apart symmetrically. When the belt is driven in the opposite direction the mechanism will be brought together.

Figure 2:
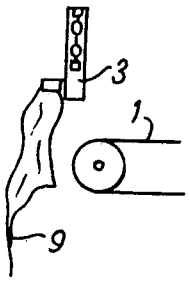
FIG. 2 is a schematic illustration in side elevation of the FIG. 1 arrangement.

A laundry article 9 is shown and in order to feed it to the ironing machine an operator takes one edge and places it between the jaws of mechanisms 2 and 3 (see FIG. 2 for details of 3). The jaws are urged together by spring force to hold the article. FIG. 2 shows in side elevation the situation of the mechanism 3 thus holding the article 9 which is draped down before the conveyor 1.

Figure 3:
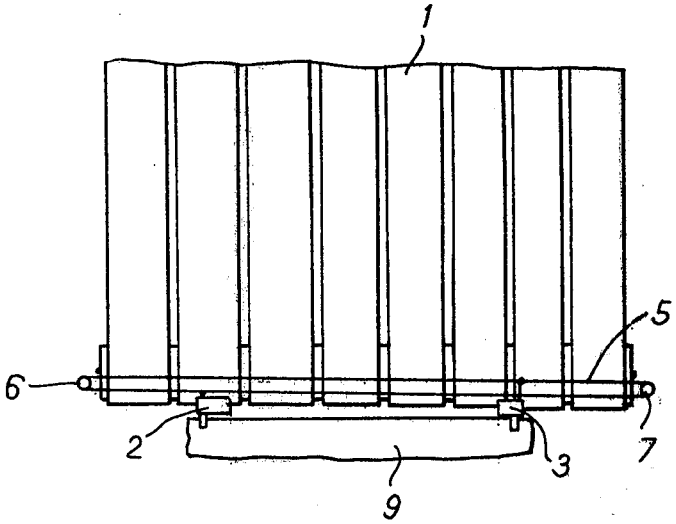
FIG. 3 is a schematic illustration in plan view of the machine showing a laundry article held taut.

Having loaded the article, the operator presses a button (not shown) and the belt 5 is driven to draw the jaws apart. As the jaws are drawn apart the leading edge of the article is allowed to run transversely through the jaws. In a manner to be described, there is a sensor arranged on each jaw mechanism so as to detect the passage of the side edge of the article. When the side edge of the article is detected the respective jaw mechanism is actuated to hold the corner formly and prevent further transverse movement of the article through the jaws. Thus, ultimately the two jaw mechanisms will hold respective corners of the article and will be positioned symmetrically with respect to the centre line with the leading edge of the article held taut. This condition is shown in FIG. 3. The drive belt 5 is so arranged that the drive is stopped with a predetermined tension in the leading edge of the article. At this time a release mechanism is actuated to open the jaws and a blast of air is forwardly directed by an air jet arrangement (not shown) to direct the leading edge of the article on to the conveyor as it falls from the jaws. The article is thereby carried forward on the conveyor to the ironing machine. It will be seen with the arrangement described that it is not necessary for the operator to place the corners of the article in mechanisms 2 and 3. All that is necessary is to insert a part of the leading edge so that it bridges the adjacent jaws. The jaw mechanisms will then run to the corners of the article and position the article centrally with respect to the conveyor.

Referring now to FIGS. 4 to 7 there is shown the right-hand jaw mechanism 3 of FIGS. 1 to 3 The jaw mechanisms are mounted to run on a track across the machine, the track being constituted by two tubes 11 and 11' welded to a steel web 12. Each mechanism has a frame constituted by a pair of plates 13. Two upper rollers 14 mounted in the upper side of frame run on the upper tube 11 and a lower roller 15 bears on the underside of the lower tube 11.

The upper jaw of the mechanism is constituted by a roller 16 and the lower jaw is constituted by a smooth plate 17. Plate 17 is mounted on an arm 18. Arm 18 is fixed on a shaft 19 which is rotatably mounted in the frame and the other end of which carries a release arm 20. A spring 34 couples arm 20 to the frame to urge the jaws together. In order to open the jaws to release the article, a bar 21 is depressed. Bar 21 runs across the machine and engages a stub 36 which projects from the end of arm 20. Plate 17 has an aperture 22 through which projects a tongue 23. Tongue 23 is mounted on an extension 24 of a jamming lever arm 25, which is pivoted about an axis parallel to the axis of rotation of roller 16 by virtue of being mounted on a sleeve 26 which is free on shaft 19. A spring 27 couples the arm 25 to the frame, thereby urging the tongue upwardly through the aperture 22. An 'L' shaped counter-plate 28 (FIG. 4) is situated a short distance above plate 17 and this also has a slot 38 to accommodate the tongue.

In use, part of the edge of the laundry article is inserted between the roller 16 and the plate 17, thereby depressing tongue 23. The article is held in place by the effect of the spring 34 on plate 17. As the jaw mechanism travels outwardly the article runs across the mouth of the jaws, rotating roller 16 and sliding over plate 17. In order to help prevent the edge of the article from running out of the jaws, jaw plate 17 is provided with an inwardly angled outer edge 29. The article drapes over the plate 17 and the effect of edge 29 is to guide the article inwardly as it is drawn up and over the plate. This inward feeding effect might be enhanced by the additional provision of appropriate helical ribbing or grooving 30 on the surface of the roller as shown in FIGS. 5 and 6.

Finally, the corner of the article passes tongue 23 and the tongue and arm 25 rise under the effect of spring 27. FIG. 7 illustrates best the configuration of the brake constituted by arm 25. Arm 25 has a nose 31 which normally is just clear of the surface of a wheel 32 which constitutes part of the roller 16, being fixed with the roller proper on the same shaft. When arm 25 rises on passage of the side edge of the article the nose engages the surface of the wheel 32 at a position slightly forward (having regard to the direction of rotation of the wheel) of the line 33 joining the axes of the roller and the pivot for arm 25. This means that the rotation of the wheel jams the nose against the wheel and stops the wheel and roller immediately. This stops the article running through the jaws so that it is held at the corner.

When both jaws have locked, the article is thereby tensioned symmetrically with respect to the feed line. The tension stops further outward movement of the jaw mechanisms by means not shown. A motion detector (not shown) is associated with the drive of belt 5 (FIG. 1) and when motion ceases a signal is generated to operate release bar 21 automatically. This depresses plate 17 to release the article and, by co-operation of plate 17 with tongue 23, unlocks the jamming arm 25 from the wheel 32.

In the arrangement described above with reference to the drawings the feeding line along which the centre lines of the articles are fed is the centre line of the machine. Generally, however, small-piece articles will be fed along a number of parallel lanes. In this case the invention will provide a pair of jaw mechanisms for each lane, the pairs of jaw mechanisms being operable independently, side by side, and being centred on the feeding line of their respective lanes.

The invention is not restricted to the details of the embodiment described with reference to the drawings. For example, instead of being directly mechanically operated, the brake mechanism for the roller may be electro-mechanical, being responsive to actuation of a micro-switch which is operated by the movement of tongue 23.

I claim:

1. An apparatus for finding and clamping the corners of the leading edge of a rectangular laundry flatwork piece so as to be able to fully extend said leading edge, said apparatus comprising:

a pair of clamp and guide means selectively operable to a clamping or to an unlocked condition, each of said clamp and guide means having a leading edge accepting configuration for accepting arbitrary portions of said leading edge with said pair of clamp and guide means disposed closer together than the length of said leading edge, said clamp and guide means captively guiding said leading edge for passage throught said guide means;

first means for effecting relative motion between portions of said leading edge of said piece and each of said clamp and guide means while in said unlocked condition to bring each of the leading edge corners of said piece toward the closest clamp and guide means; and, sensing means associated with each clamp and guide means to detect the passage of a leading edge corner closed to each of said clamp and guide means, said pair of clamp and guide means responding to the detection of passage of a leading edge corner past the associated sensing means by being actuated to said clamping condition to clamp against the associated corner portion of said leading edge.

2. The apparatus of claim 1 further comprising means for moving said pair of clamp and guide means apart so as to fully extend said leading edge after both said clamp and guide means have been actuated to said clamping condition.

3. The apparatus of claim 1 wherein each of said sensing means comprising a mechanical feeler which is resiliently urged against a portion of said leading edge of said piece outboard of the clamping portion of said clamp and guide means, said feeler moving from a first piece-contacting position to a second non-piece-contacting position upon passage of a side edge of a leading edge corner of said piece, said movement to said second position being used to actuate its associated clamp and guide means from an unlocked to a clamped condition.

4. The apparatus of claim 1 wherein said first means includes means for moving at least one of said clamp and guide means in said unlocked condition away from the other, and wherein the moving clamp and guide means continues to move at least until both are clamped and said piece is fully spread.

5. The apparatus of claim 4 further including means for positioning said clamp and guide means equal distances on opposite sides of a chosen centerline with said leading edge being fully extended.

6. The apparatus of claim 5 further including means for placing said pair of clamp and guide means close together symmetrically disposed about said chosen centerline for loading said piece and for thereafter moving said pair of clamp and guide means away from each other symmetrically about said centerline, each of said clamp and guide means remaining in said unlocked condition until a corner passage is detected by its associated sensing means, each of said clamp and guide means being actuated responsive to the associated sensing means to said clamping condition upon said corner passage, whereby after the second of said clamp and guide means is actuated to said clamping condition, further mutual outward travel of said clamp and guide means tensions said leading edge positioned symmetrically about said centerline.

7. The apparatus of claim 6 further comprising means for completely disengaging said pair of clamp and guide means from said piece after extension about said centerline whereby said piece falls away from said pair of clamp and guide means to fall symmetrically disposed about said centerline.

8. The apparatus of claim 7 in combination with a conveyor, said apparatus disposed with respect to said conveyor such that said chosen centerline is centered along a chosen feeding axis of said conveyor such that said complete disengagement deposits said piece on said conveyor symmetrically disposed about said feeding axis.

9. The apparatus of claim 6 wherein each of said clamp and guide means includes:

at least one roller means disposed to be rotated by the passage of the leading edge of said piece thereby;

tensioning means for tensioning said roller into frictional engagement with a portion of said leading edge; and, braking means responsive to said associated sensing means for preventing said at least one roller from rotating so as to cause said clamping condition.

10. The apparatus of claim 9 wherein said tensioning means includes:

a guide member proximate to the surface of said at least one roller for supporting a portion of said leading edge between said plate and said surface of said at least one roller; and, biasing means for urging said at least one roller and said guide member into contact, whereby a portion of said leading edge is brought into frictional driving engagement with said at least one roller.

11. The apparatus of claim 10 wherein said braking means comprising at least one jamming member pivoted about an axis parallel with the axis of said at least one roller and movably mounted so as to be selectively movable into or out of contact with the surface of said at least one roller so as to jam and lock said at least one roller when moved into contact therewith so as to prevent the rotation thereof.

12. The apparatus of claim 11 wherein each of said associated sensing means comprising a tongue which is urged by a spring to project through an aperature in said guide member, said tongue being mechanically linked to said jamming member, said tongue being restrained from further passage into said aperture by the presence of a portion of said leading edge over said aperture, said tongue being resiliently urged further into said aperture upon removal of said restraint by passage of a side edge of a leading edge corner of said piece thereby, said movement of said tongue actuating said jamming member into braking contact with the surface of its associated roller.

13. The apparatus of claim 12 wherein each of said clamp and guide means is operable to said unlocked condition by moving said guide member away from said at least one roller, said tongue being configured to be engaged by said guide member and to be moved away from said roller by said motion of said guide member, said motion of said tongue away from said roller being communicated to said jamming member to release said jamming member from engagement with said roller.

14. The apparatus of claims 9 or 13 wherein said roller means includes helical roller ribbing or groovings arranged to bias the piece into the associated clamp and guide means as said roller means rotates.

15. The apparatus of claims 10 or 13 wherein at least a portion of the outer end of each of said guide member is configured at an angle to the axis of the associated at least one roller, said angle chosen such that said leading edge of said piece when positioned draped over the outer edge of each of said guide member is guided to prevent it from running off of the associated clamp and guide means.

* * * * *